United States Patent [19]

Kashiwagi et al.

[11] Patent Number: 4,579,091

[45] Date of Patent: Apr. 1, 1986

[54] CYLINDER HEAD FOR INTERNAL COMBUSTION ENGINES

[75] Inventors: Yoshio Kashiwagi, Mie; Tsuneo Tanai, Tokyo, both of Japan

[73] Assignee: Honda Giken Kogyo Kabushiki Kaisha, Tokyo, Japan

[21] Appl. No.: 605,639

[22] Filed: Apr. 30, 1984

[30] Foreign Application Priority Data

May 2, 1983 [JP] Japan ..... 58-77902

[51] Int. Cl.[4] ..... F02F 1/36

[52] U.S. Cl. ..... 123/41.82 R; 123/193 H

[58] Field of Search ..... 123/41.72, 41.74, 41.79, 123/41.82 R, 41.82 A, 193 H

[56] References Cited

U.S. PATENT DOCUMENTS 3,353,522 11/1967 Ley ..... 123/41.79

3,491,731 1/1970 Dinger et al. ..... 123/41.82 R

FOREIGN PATENT DOCUMENTS 2617938 11/1976 Fed. Rep. of Germany ... 123/193 H

*Primary Examiner*—William A. Cuchlinski, Jr.

*Attorney, Agent, or Firm*—Lyon & Lyon

[57] ABSTRACT

A cylinder head for a water-cooled engine of the cross-flow type with the intake passages on one side and the exhaust passages on the other side and a central water jacket formed longitudinal down the middle of the head. Sprues are formed in the head casting to extend lateral across the head through the central water jacket to integrally join the walls forming the intake and exhaust passages. In a modification, a passageway is formed in a sprue to conducted exhaust gases from an exhaust passage to the intake side of the head for use in an exhaust gas recirculation system.

3 Claims, 5 Drawing Figures

CYLINDER HEAD FOR INTERNAL COMBUSTION ENGINES

The present invention relates to a cylinder head for a cross flow type water-cooled four-cycle internal combustion engine, which can be easily die-cast.

In the cylinder head of this type of internal combustion engine, the intake passages and exhaust passages are arranged in a facing manner at both the sides of the axis of the crankshaft, and a water jacket is made to longitudinally extend the length of the head between the intake and exhaust passages. Thus, the cylinder head has a complicated shape as a whole, and the aforementioned water jacket is required to have a capacity enough to enhance the cooling effect of the cylinder head.

If the cylinder head is to be molded by the usual die-casting process, the die is formed into a complicated shape, and a large core is set in the die so that the aforementioned water jacket may be formed. This may result in the molten metal being inhibited or reluctant to flow to every corner of the die to thereby deteriorate the molding efficiency, thus disadvantageously causing some defective casting and a rise in the production cost.

The present invention has an object to provide a cylinder head which can be efficiently die-cast without the aforementioned disadvantage by improving the structure of the cylinder head without any substantial increase in cost.

The present invention will be described in the following in connection with one embodiment thereof with reference to the accompanying drawings in which.

Generally indicated by reference letter H is a cylinder head of a cross flow type water-cooled four-cylinder four-cycle internal combustion engine, which is molded of aluminum alloy by the usual die-casting process.

Figure 3:
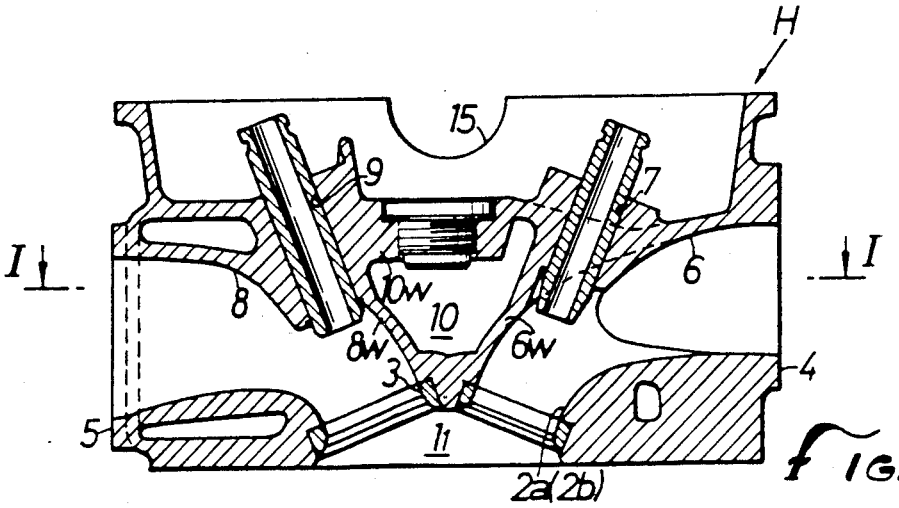
FIG. 3 is a sectional view taken substantially on the line III—III of FIG. 1.
Figure 4:
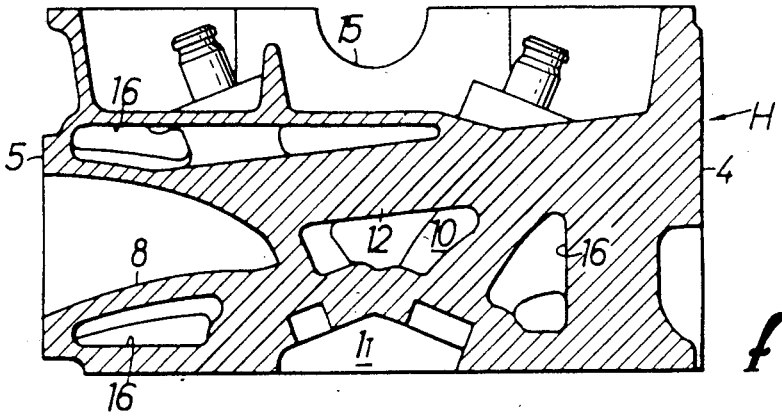
FIG. 4 is a sectional view taken on the line IV—IV of FIG. 1.

On the bottom of the cylinder head H thus constructed, four combustion chambers $1_1$ to $1_4$, are arranged in tandem along the longitudinal axis L—L thereof. Each of the combustion chambers $1_1$ to $1_4$ is formed with a pair of intake valve ports 2*a* and 2*b* at one side of the aforementioned axis L—L and with one exhaust valve port 3 at the other side. At one side half (i.e., at the righthand half, as viewed in FIG. 3) across the axis L—L of the cylinder head H, there are juxtaposed four bifurcated intake passages 6 which have their inner ends communicating with the aforementioned paired intake valve ports 2*a* and 2*b* and their outer ends opened in one side face 4 of the cylinder head H. In the upper portion of each intake valve port 2*a* and 2*b* of each intake passage 6, there is integrally formed a valve guide portion 7 for receiving a valve guide insert for slidably guiding the intake valves. At the other side half (i.e., at the lefthand half, as viewed in FIG. 3) across the axis L—L of the cylinder head H, on the other hand, there are juxtaposed four exhaust passages 8 which have their inner ends communicating with the aforementioned one exhaust valve port 3 and their outer ends opened in the other side face 5 of the cylinder head H. In the upper portion of each exhaust passage 8, there is formed a valve guide portion 9 for receiving a valve guide insert for slidably guiding the exhaust valve.

Between the groups of the intake passages 6 and the exhaust passages 8 juxtaposed across the axis L—L of the cylinder block H, there is formed a water jacket 10 which extends longitudinally along the aforementioned axis L—L. A jacket wall 10*w* defining said water jacket 10 is partially formed by the walls 6*w* of the aforementioned intake passages 6 and the walls 8*w* of the aforementioned exhaust passages 8.

Figure 1:
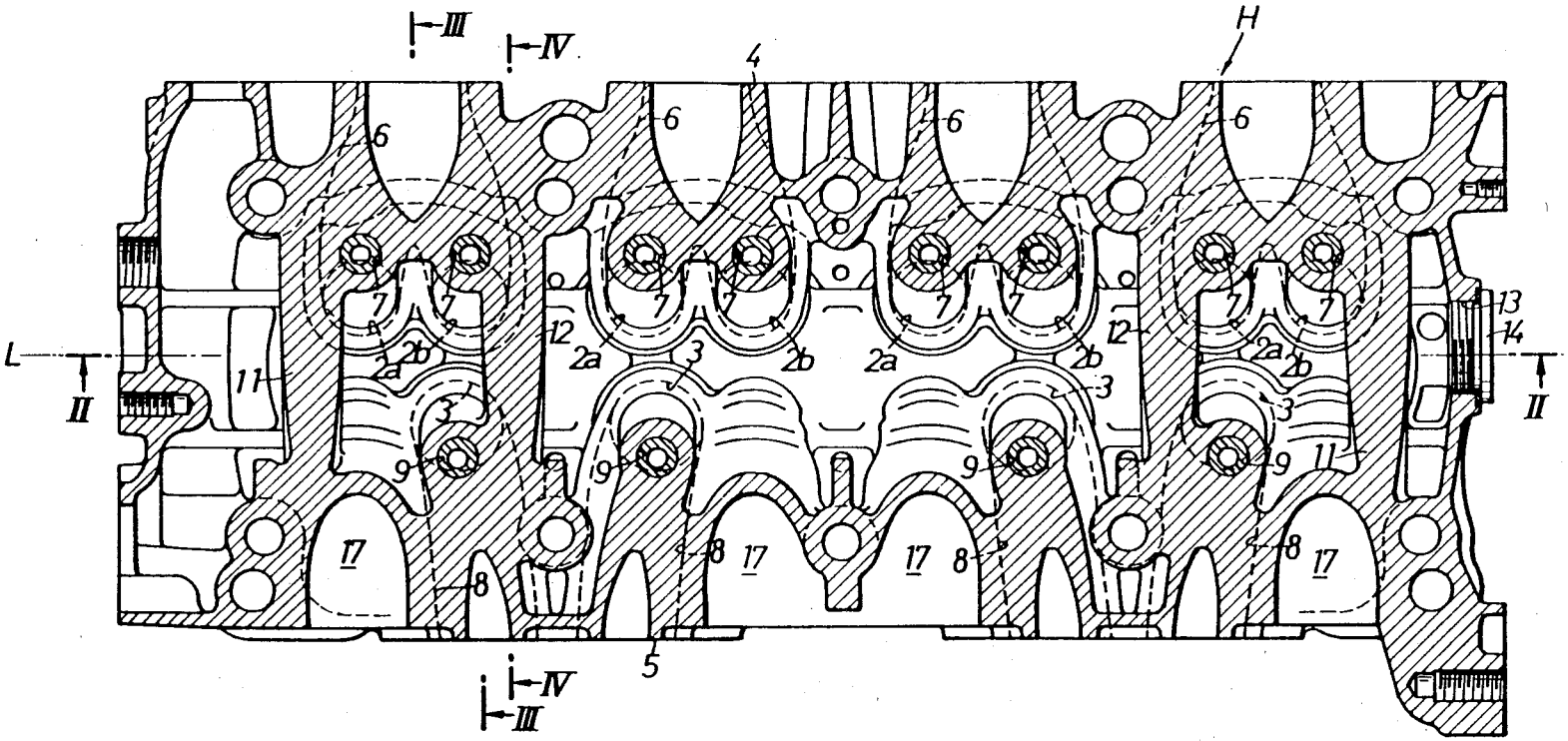
FIG. 1 is a top sectional view of the cylinder head of this invention taken substantially on the line I—I in FIG. 3.
Figure 2:
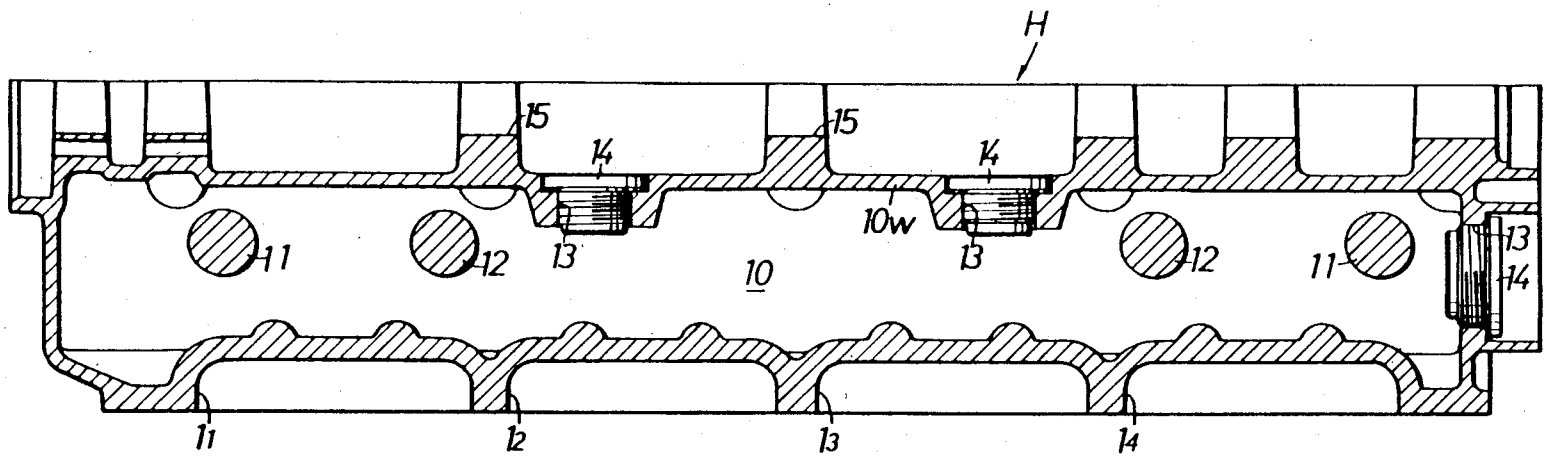
FIG. 2 is a longitudinal section taken substantially on the line II—II in FIG. 1.

As better seen from FIG. 1, the walls 6*w* of the intake passages 6 and the walls 8*w* of the exhaust passages 8 above the combustion chambers $1_1$ and $1_4$, at both the longitudinally end portions of the cylinder head H are integrally jointed by two sprue forming joint members 11 and 12 which have a generally cylindrical or round section and which cross the upper portion of the aforementioned water jacket 10 spaced from the top and bottom of the water jacket.

The upper walls and end walls of the water jacket 10 are formed with a plurality of through holes 13 for extracting a core therethrough. These through holes 13 are closed by means of plugs 14.

The reference numerals 15, 16 and 17 appearing in the drawings indicate bearing portions of cam shafts, additional water jackets, and the spaces for receiving ignition plugs, respectively.

In the manufacturing process wherein the aforementioned cylinder head H is to be die-cast, the core for forming the aforementioned water jacket 10 or the like is set as usual in the die. After that, molten metal is injected under pressure into the aforementioned die. Since, in this invention, the cylinder head H is integrally molded with the sprue forming joint members 11 and 12 for integrally jointing the walls 6*w* of the intake passages 6 and the walls 8*w* of the exhaust passages 8, the molten metal flows from the intake passage walls 6*w* (or the exhaust passage walls 8*w*) through the aforementioned sprue forming joint passages 11 and 12 to the exhaust passage walls 8*w* (or the intake passage walls 6*w*) so that it may promptly and smoothly flow into every corner of the cylinder head H as a whole. Thus, the desired molding is achieved, i.e., the cylinder head H can be die-cast in a remarkably improved molding efficiency.

Figure 5:
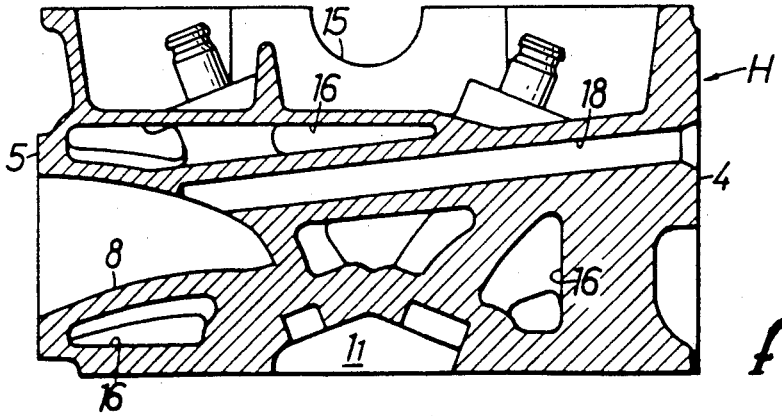
FIG. 5 is a sectional view similar to FIG. 4 of a modified form.

FIG. 5 shows another embodiment of the present invention. In this embodiment, at least one of the aforementioned plural sprue forming joint members 11 and 12 is formed with an exhaust gas recirculation (EGR passage) 18. This passage 18 has its inner end opened in the exhaust passage 8 and its outer end opened in one side face 4 of the cylinder H at the intake passage side and communicating with the not-shown engine intake system. A portion of the exhaust gas in the exhaust passages 8 is recirculated into the intake system through the aforementioned exhaust gas recirculation passage 18.

As has been described hereinbefore, according to the present invention, there is provided a cylinder head for a cross flow type water-cooled internal combustion engine, in which the water jacket is made to longitudinally extend in a central portion thereof and in which the intake passages and the exhaust passages are arranged in a facing manner at both the sides of the water jacket, said cylinder head being characterized in that the sprue forming joint members for integrally jointing the walls of the intake passages and the walls of the exhaust passages are disposed across the water jacket. As a result, when the aforementioned cylinder head is to be die-cast, the molten metal flows smoothly and promptly around the aforementioned joint members and between the walls of the intake passages and the exhaust passages so that it can be efficiently molded into a cylinder head having a desired shape without any defect. As a result, the molding cost of the cylinder head can be remarkably reduced.

What is claimed:

1. A cylinder head for a water cooled engine of the cross-flow type with the intake passages and exhaust passages on opposite sides of the a central water jacket, comprising a casting having portions forming intake passage walls and exhaust passage walls as part of the central water jacket, and sprue means extending between and integrally joining said intake passage walls and said exhaust passage walls, a passageway provided in said sprue means for conducting exhaust gases from at least one of said exhaust passages to the opposite side of the cylinder head for exhaust gas recirculation into the intake passage.

2. A cylinder head for a water-cooled, multiple-cylinder, internal combustion engine of the cross-flow type with intake passages and exhaust passages on opposite sides of a central water jacket, comprising, a metal casting having portions forming multiple intake passage walls, multiple exhaust passage walls, and additional walls for comprising the central water jacket, a plurality of substantially cylindrical and relatively large sprue means extending laterally across the cylinder head between and integrally jointing a plurality of said intake passage walls to said exhaust passage walls, and said sprue means extending through the water jacket in spaced relationship to said additional walls above and below said sprue means.

3. A cylinder head for a water-cooled, multiple-cylinder, internal combustion engine of the cross-flow type with intake passages and exhaust passages on opposite sides of a central water jacket, comprising, a metal casting having portions forming multiple intake passage walls, multiple exhaust passage walls, and additional walls for comprising the central water jacket, at least one relatively cylindrical sprue means extending laterally across the cylinder head between and integrally jointing a plurality of said intake passage walls to said exhaust passage walls at each end of the cylinder head for enhancing the flow of metal during casting of the cylinder head, and said sprue means extending through the water jacket in spaced relationship to said additional walls above and below said sprue means.

* * * * *